US012247798B1

(12) United States Patent
Craig

(10) Patent No.: US 12,247,798 B1
(45) Date of Patent: Mar. 11, 2025

(54) WEAPON TRIGGER INTERLOCK AND MONITORING SYSTEM

(71) Applicant: Sylvia Craig, San Antonio, TX (US)

(72) Inventor: Sylvia Craig, San Antonio, TX (US)

( * ) Notice: Subject to any disclaimer, the term of this patent is extended or adjusted under 35 U.S.C. 154(b) by 185 days.

(21) Appl. No.: 18/055,527

(22) Filed: Nov. 15, 2022

Related U.S. Application Data

(60) Provisional application No. 63/408,991, filed on Sep. 22, 2022, provisional application No. 63/244,773, filed on Sep. 16, 2021.

(51) Int. Cl.
*F41A 17/06* (2006.01)

(52) U.S. Cl.
CPC ..... *F41A 17/066* (2013.01)

(58) Field of Classification Search
CPC ..... F41A 17/063; F41A 17/066; F41A 17/46; F41A 17/08; F41A 17/38; F41A 9/65; F41A 17/06; F41A 17/34; F41A 17/36; F41A 9/62; F41A 17/48; F41A 35/06; F41A 21/48; F41A 11/02; F41C 23/16; F41C 23/14; F41B 11/62; F41B 11/73
USPC ..... 42/70.11, 70.01, 70.02, 6, 69.01
See application file for complete search history.

(56) References Cited

U.S. PATENT DOCUMENTS 6,415,542 B1 * 7/2002 Bates ..... F41A 17/06 42/70.11
8,418,391 B2 * 4/2013 Kemmerer ..... F41A 17/066 42/70.05
10,612,877 B1 * 4/2020 Harris ..... F41A 17/066
11,156,420 B1 * 10/2021 Clark ..... F41C 23/16
2007/0271830 A1 * 11/2007 Holt ..... F41A 17/063 42/70.01
2013/0019510 A1 * 1/2013 Kemmerer ..... F41A 17/066 42/70.11
2013/0019512 A1 * 1/2013 Kemmerer ..... F41A 17/066 42/70.11
2013/0125441 A1 * 5/2013 Westwood ..... F41A 17/28 42/70.11
2014/0366421 A1 * 12/2014 Arif ..... F41A 17/46 42/70.11
2016/0054080 A1 * 2/2016 Haimi ..... F41A 17/54 70/263
2016/0054083 A1 * 2/2016 Kiyani ..... F41A 17/066 42/70.11

(Continued)

*Primary Examiner* — Michael D David
(74) *Attorney, Agent, or Firm* — Gunn Lee + Cave P.C.; Julie P. Bell

(57) ABSTRACT

A firearm activation and monitoring system which tracks, monitors, and automatically prevents a firearm from firing when a user is not in a suitable state of mind or is not an authorized user, as well as a method for activating and monitoring a firearm. The firearm activation and monitoring system generally comprises a firearm having a trigger and grip area, a plurality of biometric sensors located on the grip area which measure biometric data of a user, a trigger interlock, and a main microcontroller. The trigger interlock prevents the trigger from firing the firearm when the trigger interlock is in its normal or default position. To unlock the trigger, the user holds the grip area to activate the biometric sensors, and if the user is in an acceptable mental state, the main microcontroller will send an electrical signal to the trigger interlock, which unlocks the trigger and allows the user to pull the trigger of the firearm.

3 Claims, 3 Drawing Sheets

(56) References Cited

U.S. PATENT DOCUMENTS

| | | | | |
|---|---|---|---|---|
| 2017/0146310 | A1* | 5/2017 | Biran | F41A 17/066 |
| 2017/0162030 | A1* | 6/2017 | Rajnath | F41A 17/063 |
| 2017/0286654 | A1* | 10/2017 | Nicoll | F41A 17/08 |
| 2017/0350667 | A1* | 12/2017 | Fishbein | F41A 17/46 |
| 2019/0003804 | A1* | 1/2019 | Deng | F41A 35/00 |
| 2019/0186868 | A1* | 6/2019 | Cordero Pardo | F41C 33/029 |
| 2019/0212086 | A1* | 7/2019 | Shiner | F41A 17/54 |
| 2019/0340856 | A1* | 11/2019 | Gilbert | E05B 47/0012 |
| 2019/0376756 | A1* | 12/2019 | Nieh | F41A 17/08 |
| 2020/0003511 | A1* | 1/2020 | Deng | F41A 17/06 |
| 2020/0003512 | A1* | 1/2020 | Deng | F41A 17/06 |
| 2020/0011629 | A1* | 1/2020 | Deng | G01S 19/18 |
| 2020/0355456 | A1* | 11/2020 | Deng | H04N 23/66 |
| 2020/0355457 | A1* | 11/2020 | Deng | G01S 5/0009 |
| 2021/0185138 | A1* | 6/2021 | Gant | H04L 63/0861 |
| 2022/0065575 | A1* | 3/2022 | Canty | H04N 5/28 |
| 2022/0221240 | A1* | 7/2022 | Song | F41A 17/063 |
| 2023/0168056 | A1* | 6/2023 | Galie | F41A 17/06 42/69.03 |
| 2023/0288167 | A1* | 9/2023 | Broadway | F41G 3/04 |

* cited by examiner

WEAPON TRIGGER INTERLOCK AND MONITORING SYSTEM

CROSS-REFERENCES TO RELATED APPLICATIONS

This application is a non-provisional application claiming the benefit of priority from U.S. Provisional Application No. 63/244,773, filed Sep. 16, 2021, and U.S. Provisional Application No. 63/408,991, filed Sep. 22, 2022, which are hereby incorporated herein, in their entirety, by reference.

STATEMENT REGARDING FEDERALLY SPONSORED RESEARCH OR DEVELOPMENT

Not applicable.

BACKGROUND OF THE INVENTION

1. Field of the Invention

The present invention relates generally to an activation and monitoring system for authorized use of a weapon.

2. Background of Related Art

According to the Centers for Disease Control and Prevention, firearm injuries and deaths continue to be a significant and growing public health problem in the United States. Firearm shootings can result from interpersonal violence, legal intervention, intentional self-infliction, or unintentional reasons. Whether a single shooting or part of mass shooting, firearm shootings can forever alter the lives of victims due to mental trauma, physical injuries, and death. Many of these shootings occur when a firearm, such as a handgun, is used in a state of intense fear, anger, or mental distress. Guns can be equipped with a trigger lock to prevent unauthorized use, but owners of the gun can remove the lock when they are in a state of fear, anger, or mental distress. Additionally, guns that are obtained illegally or stolen can be used in shootings. Finally, being able to determine which guns belong to which user, where the guns are at all times, and when a gun is fired, or about to be fired, will provide law enforcement officials the ability to reduce or even eliminate crimes involving firearms. Accordingly, there is a need for a means by which firearms can be tracked, monitored, and automatically secured from firing when a user is not in a suitable state of mind or is not an authorized user.

Biometric sensors that measure biological signals and other biological information (biometric data), such as skin temperature, sweat gland activity, muscle activity, heart rate, and pulse, from humans can be used to fulfill this need. Biometric data can be indicators of a person's autonomic nervous system, which is associated with emotion, cognition, and stress. Accordingly, biometric data can be utilized to measure a person's mental state. For example, electrodermal activity (EDA), is a biomarker of sympathetic nervous system activation and is considered one of the most sensitive and valid markers of emotional arousal. During high levels of emotional arousal such as stressful states, sweat secretion is intensely activated, which can be measured using an EDA sensor. There are several wearable consumer devices on the market that monitor human physiological and mental states by measuring biometric data. For example, the Moodmetric EDA Ring detects stress levels by measuring electrodermal activity and skin conductivity on a finger of the wearer, and the Fitbit Sense smart watch which monitors stress of the wearer through an ECG heart monitor, skin temperature sensor, and EDA sensor.

The development of a firearm activation and monitoring system that utilizes biometric sensors fulfills the need for a means by which firearms can be tracked, monitored, and automatically secured from firing when a user is not in a suitable state of mind or is not an authorized user.

SUMMARY OF THE INVENTION

The present invention discloses a firearm activation and monitoring system that can track, monitor, and automatically secure a firearm from firing when a user is not in a suitable state of mind or is not an authorized user. The system can also notify third parties, such as law enforcement personnel, residences, and public buildings, when the firearm is unlocked or fired. The firearm activation and monitoring system includes a firearm having a grip area and a trigger, biometric sensors, a trigger interlock, a charging port, a charging regulator circuit, a rechargeable battery, a main microcontroller, a global positioning system (GPS) receiver, a Bluetooth transmitter, a Wi-Fi transmitter, and a mobile transmitter.

The trigger interlock is slidably or rotatably mounted onto the firearm and positioned directly behind the trigger. When the trigger interlock is in a first position, the trigger interlock prevents movement of the trigger and firing of the firearm. The trigger interlock is in the first position in its normal or default state. When the trigger interlock moves into a second position, the trigger interlock slides or rotates away from the trigger such that the trigger can move freely and operate the firing mechanism of the firearm. The trigger interlock must receive an appropriate electrical signal from the main microcontroller in order for the trigger interlock to move into the second position.

The biometric sensors are positioned inside of the grip area of the firearm and extend through openings which are located on the outer surface of the grip area. The biometric sensors measure different biometric data, including skin temperature, sweat gland activity, muscle activity, and heart rate and pulse, from a user when the user is holding the grip area. The biometric sensors capture the biometric data so that the firearm activation and monitoring system can determine the mental state of the user, such as angry versus calm or irrational versus rational.

The charging port, regulator circuit, rechargeable battery, main microcontroller, GPS receiver, Bluetooth transmitter, Wi-Fi transmitter, and mobile transmitter are positioned inside the firearm. Power to operate the firearm activation and monitoring system is supplied into the charging port, routed to the charging regulator circuit, and then routed to the rechargeable battery. Power from the rechargeable battery is then routed to the main microcontroller. The biometric sensors and GPS receiver serve as an input to the main microcontroller while the trigger interlock serves as an output to the main microcontroller. The Bluetooth transmitter, Wi-Fi transmitter, and mobile transmitter serve as both inputs and outputs to the main microcontroller.

The user holds the firearm and a first mobile device which is electronically connected (paired) to the firearm through the Bluetooth transmitter. The biometric sensors capture biometric data from the user and the biometric data is transmitted from the biometric sensors to the main microcontroller. The main microcontroller measures the biometric data of the user, creates a biometric data report of the user, and then transmits the biometric data report to the first mobile device. A dedicated application running on the first mobile device verifies the biometric data report to determine whether the mental state of the user is acceptable. If the biometric data report is acceptable, then the application running on the first mobile device creates an authorization report, and the first mobile device transmits the authorization report to the main microcontroller. The main microcontroller then transmits an electrical signal to the trigger interlock which causes the trigger interlock to move away from the trigger such that the trigger is unlocked and the user can fire the firearm.

The application running on the first mobile device has a process to verify the identify of the user of the firearm, such as a fingerprint verification or input of a personal identification number (PIN), which would be required before the firearm may be fired. The application running on the first mobile device can also notify the user if the biometric data report and verification of the user are acceptable. In an alternative embodiment, the main microcontroller can verify the biometric data report to determine whether the mental state of the user is acceptable without the necessity of the first remote device.

The location information of the firearm is determined by a GPS radio frequency (RF) signal from a GPS satellite and is received by the GPS receiver and transmitted to the main microcontroller. Other data, including the status of the firearm (locked or unlocked), whether the firearm has been fired, and the identification of the user, is also captured and stored in the main microcontroller. The main microcontroller transmits the location information and other data to the first mobile device. The first mobile device transmits total historical data from the firearm to a local mobile data tower. Total historical data from the firearm is then transmitted from the mobile data tower to the Internet. The total historical data from the firearm can be directly transmitted from the main microcontroller to the Internet through the Wi-Fi transmitter and the mobile transmitter of the firearm as well. The Internet is connected to a secure data center which stores historical data from the firearm. In the event of a firing or unlocking, the secure data center can relay this information to law enforcement personnel, residences, and public buildings, as well as dedicated subscribers who are running a dedicated alerting app on a second cellular device.

During utilization of the system, the following procedure would be initiated: The user of the firearm first performs an identification process via a fingerprint or PIN on the first mobile telephone. Next, the grip area of the firearm is grabbed thus activating the biometric sensors. If the user is in a calm and acceptable state, the main microcontroller will send an electrical signal to the trigger interlock, thus unlocking the trigger and allowing the trigger to be pulled and the firearm to be fired. Upon firing of the firearm, identification and location information would be forwarded to all law enforcement personnel, residences, public buildings, and subscribers, thus allowing them to take corrective safety action for themselves or others. The law enforcement personnel would automatically respond to the location to perform necessary actions as well. After use of the system, the system is automatically reset by the main microcontroller and ready for additional operation as aforementioned described.

DETAILED DESCRIPTION

Figure 1:
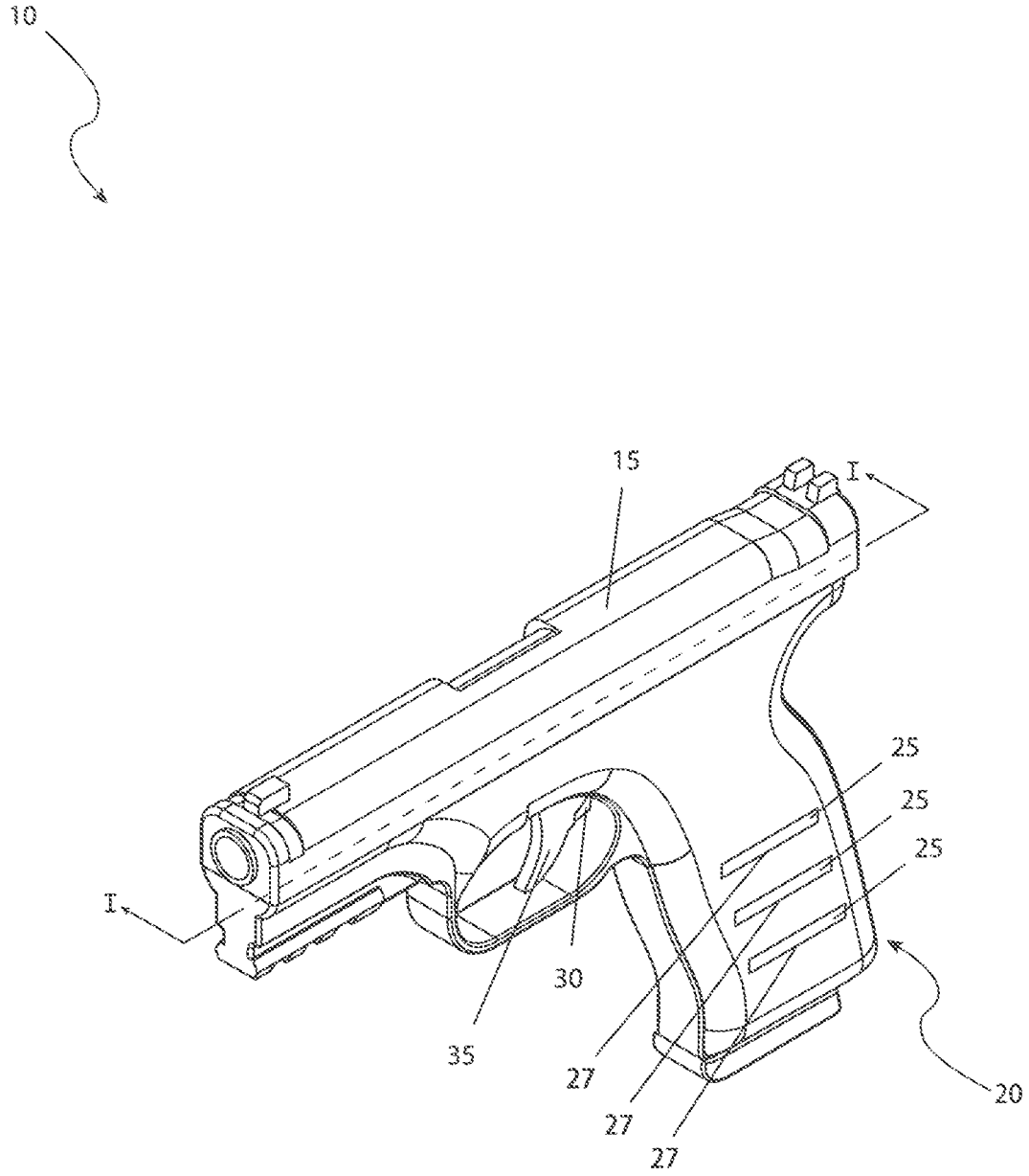
FIG. 1 is a perspective view of the firearm activation and monitoring system shown in an installed state on a firearm according to the preferred embodiment of the present invention.
Figure 2:
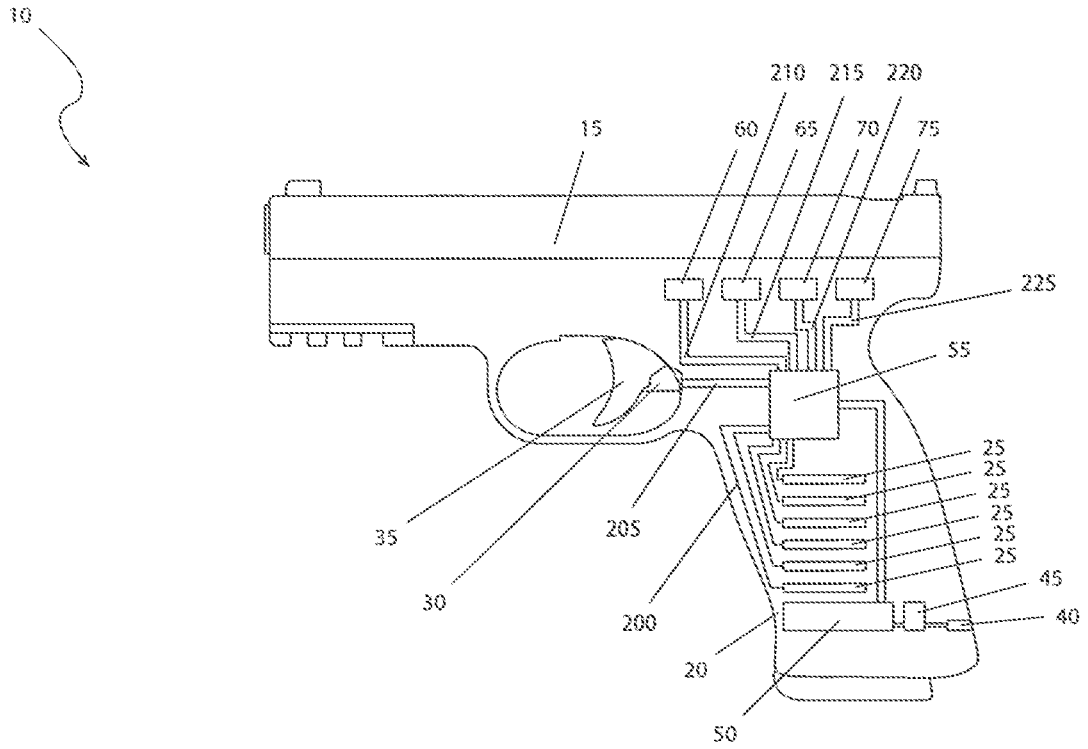
FIG. 2 is a sectional view of the firearm activation and monitoring system, as seen along a line I-I, as shown in FIG. 1, according to the preferred embodiment of the present invention.

As shown in FIGS. 1 and 2, the firearm activation and monitoring system 10 includes a firearm 15 having a grip area 20 and a trigger 35, biometric sensors 25, a trigger interlock 30, a charging port 40, a charging regulator circuit 45, a rechargeable battery 50, a main microcontroller 55, a global positioning system (GPS) receiver 60, a Bluetooth transmitter 65, a Wi-Fi transmitter 70, a mobile transmitter 75, biometric lines 200, a trigger interlock line 205, a GPS line 210, a Bluetooth line 215, a Wi-Fi line 220, and a mobile line 225. The firearm 15 in the present embodiment is depicted as an automatic handgun and provides for a variety of internal and external discrete electronics. The teachings of the firearm activation and monitoring system 10 may be applied to a wide variety of firearms 15 including but not limited to revolvers, fully and semi-automatic rifles, shotguns, black powder rifles, and the like. As such, the use of the firearm activation and monitoring system 10 on any particular style of firearm 15 is not intended to be a limiting factor of the present invention.

The trigger interlock 30 is slidably mounted onto the firearm 15 and positioned directly behind the trigger 35. The trigger interlock 30 can also be rotatably mounted onto the fire 15 or slidably and rotatably mounted onto the firearm 15. When the trigger interlock 30 is in a first position, as shown in FIGS. 1 and 2, the trigger interlock 30 is positioned such that the trigger interlock 30 prevents movement of the trigger 35 and firing of the firearm 15. When the trigger interlock 30 moves into a second position (not shown in the Figures), the trigger interlock 30 moves away from the trigger 35 such that the trigger interlock 30 no longer prevents movement of the trigger 35, and the trigger 35 can move freely and operate the firing mechanism of the firearm 15. The trigger interlock 30 is in the first position, and thus the firearm 15 cannot be fired, when the trigger interlock 30 is in its normal or default state. The trigger interlock 30 must receive an appropriate electrical signal from the main microcontroller 55 in order for the trigger interlock 30 to move into the second position, thereby unlocking the trigger 35 and allowing the firearm 15 to be fired. In such a manner, any failures of the firearm activation and monitoring system 10 such as a dead battery, communication failure, or the like, will result in the firearm being in a safe and locked state and unable to operate.

The biometric sensors 25 are positioned inside of the grip area 20 of the firearm 15 and extend through openings 27 which are located on the outer surface of the grip area 20. The biometric sensors 25 measure different biological signals and information (biometric data), including skin temperature, sweat gland activity, muscle activity, heart rate, and pulse, from a user 80 when the user 80 is holding the grip area 20 and the user's 80 skin is in contact with the biometric sensors 25. Preferably, the openings 27 and biometric sensors 25 are located on both sides of the grip area 20 (the openings 27 and biometric sensors 25 on the opposite side of the grip area 20 are not shown in the Figures). The biometric sensors 25 capture the biometric data so that the firearm activation and monitoring system 10 can determine the mental state of the user 80, such as angry versus calm or irrational versus rational.

As shown in FIG. 2, the charging port 40, regulator circuit 45, rechargeable battery 50, main microcontroller 55, GPS receiver 60, Bluetooth transmitter 65, Wi-Fi transmitter 70, mobile transmitter 75, biometric lines 200, trigger interlock line 205, GPS line 210, Bluetooth line 215, Wi-Fi line 220, and mobile line 225 are positioned inside the firearm 15. The charging port 40 is located on the rear bottom of the grip area 20 and is connected to the charging regulator circuit 45 which is connected to the rechargeable battery 50. Power to operate the firearm activation and monitoring system 10 is supplied into the charging port 40, routed to the charging regulator circuit 45, and then routed to the rechargeable battery 50. Power from the rechargeable battery 50 is then routed to the main microcontroller 55.

The main microcontroller 55 is connected to the biometric sensors 25 through the biometric lines 200, to the trigger interlock 30 through the trigger interlock line 205, to the GPS receiver 60 through the GPS line 210, to the Bluetooth transmitter 65 through the Bluetooth line 215, to the Wi-Fi transmitter 70 through the Wi-Fi line 220, and to the mobile transmitter 75 through mobile line 225. In the preferred embodiment, the biometric lines 200, trigger interlock line 205, GPS line 210, Bluetooth line 215, Wi-Fi line 220, and mobile line 225 are made of conducting and/or semiconducting materials and the biometric lines 200, trigger interlock line 205, GPS line 210, Bluetooth line 215, Wi-Fi line 220, and mobile line 225 electronically transmit signals and data between the different components. However, other materials and mechanisms for transferring data are envisioned. The biometric sensors 25 and GPS receiver 60 serve as an input to the main microcontroller 55 while the trigger interlock 30 serves as an output to the main microcontroller 55. The Bluetooth transmitter 65, Wi-Fi transmitter 70, and mobile transmitter 75 serve as both inputs and outputs to the main microcontroller 55.

Figure 3:
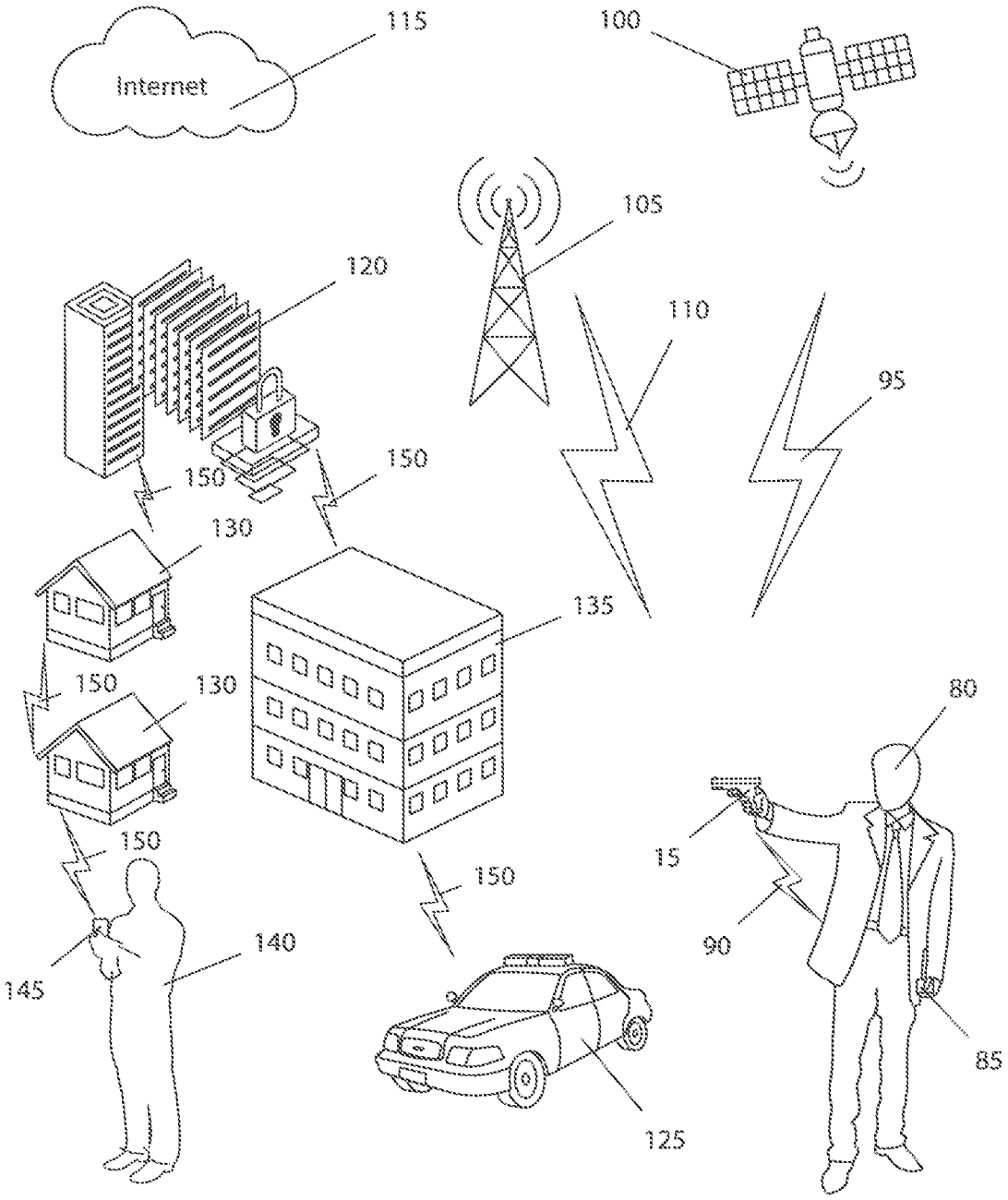
FIG. 3 is an illustrative view of the firearm activation and monitoring system shown in a utilized state according to the preferred embodiment of the present invention.

Referring to FIGS. 2 and 3, the trigger interlock 30 is in the first position such that the trigger 35 is locked and the firearm cannot be fired. The user 80 holds the firearm 15 and a first mobile device 85. The first mobile device 85 is electronically connected (paired) to the firearm 15 through a Bluetooth radio frequency (RF) signal 90 to the Bluetooth transmitter 65 of the firearm 15. When the user's 80 skin is in contact with the biometric sensors 25 of the firearm 15, the biometric sensors 25 capture biometric data from the user 80. The biometric data is transmitted from the biometric sensors 25 to the main microcontroller 55 through biometric lines 200. The main microcontroller 55 measures the biometric data of the user 80 and creates a biometric data report. The main microcontroller 55 transmits the biometric data report to the first mobile device 85 through the Bluetooth line 215, the Bluetooth transmitter 65, and the Bluetooth radio frequency signal 90. A dedicated application running on the first mobile device 85 verifies the biometric data report to determine whether the mental state of the user 80 is acceptable. If the biometric data report is acceptable, for example if the biometric data report shows the user 80 is calm, then the application running on the first mobile device 85 creates an authorization report. If the biometric data report is unacceptable, for example if the biometric data report shows the user 80 is angry, then no authorization report is created and the process ends. If the mental state report is acceptable and the authorization report is created, the first mobile device 85 transmits the authorization report to the main microcontroller 55 through the Bluetooth radio frequency signal 90, the Bluetooth transmitter 65, and Bluetooth line 215. The main microcontroller 55 then transmits an electrical signal to the trigger interlock 30, through the trigger interlock line 205, which causes the trigger interlock 30 to move into the second position away from the trigger 35 such that the trigger 35 is unlocked and the user 80 can fire the firearm 15.

Preferably, the application running on the first mobile device 85 has a process to verify the identify of the user 80 of the firearm 15, such as a fingerprint verification or input of a personal identification number (PIN), which would be required before the firearm 15 may be fired. For example, if the biometric data report is acceptable, then the application running on the first mobile device 85 will prompt the user 80 to verify their identify with their fingerprint or input of a PIN on the first mobile device 85. If the fingerprint or PIN are acceptable, the first mobile device 85 creates the authorization report and transmits the authorization report to the main microcontroller 55 through the Bluetooth radio frequency signal 90, the Bluetooth transmitter 65, and Bluetooth line 215. The main microcontroller 55 then transmits the electrical signal to the trigger interlock 30 through the trigger interlock line 205, which unlocks the trigger 35 of the firearm 15. If the fingerprint or PIN are not unacceptable, then no authorization report is created and the trigger 35 of the firearm 15 remains locked. If the firearm 15 is lost or stolen it will remain locked as the correct pairing through the Bluetooth radio frequency (RF) signal 90 and the fingerprint or PIN verification would not be available.

Ideally the application running on the first mobile device 85 will notify the user 80 if the biometric data report and verification of the user 80 are acceptable. For example, when the firearm 15 is locked, the application displays a red icon on the screen of the first mobile device 85. If the user 80 activates the biometric sensors 25 and the resulting biometric data report and the verification of the user 80 are acceptable, the application icon on the screen of the first mobile device 85 turns to green and the firearm 15 unlocks. However, if the biometric data report or the verification of the user are unacceptable, the application icon on the screen of the first mobile device 85 stays red and the firearm 15 remains locked.

In another embodiment, the main microcontroller 55 can verify the biometric data report to determine whether the mental state of the user 80 is acceptable without the necessity of the first remote device 85. If the mental state report is acceptable, then the main microcontroller 55 transmits the electrical signal to the trigger interlock 30, though the trigger interlock line 205, which causes the trigger interlock 30 to move into the second position such that the trigger 35 is unlocked and the user 80 can fire the firearm 15.

The location of the firearm 15 at all times is determined by a GPS radio frequency (RF) signal 95 from a GPS satellite 100. The location information of the firearm 15 is received by the GPS Receiver 60 and is transmitted to the main microcontroller 55 through GPS line 210. Other data, including the status of the firearm 15 (locked or unlocked), whether the firearm 15 has been fired, and the identification of the user, is also captured and stored in the main microcontroller 55. The main microcontroller 55 transmits the location information and other data to the Bluetooth transmitter 65 through Bluetooth line 215. The Bluetooth transmitter 65 then transmits the location information and other data through the Bluetooth radio frequency (RF) signal 90 to the first mobile device 85.

The first mobile device 85 transmits total historical data from the firearm 15, including the ownership of the firearm 15, location of the firearm 15, status of the firearm 15 (locked or unlocked), identity of the user 80, and whether the firearm 15 has been fired, to a local mobile data tower 105 through a radio frequency (RF) signal 150. Total historical data from the firearm 15 is then transmitted from the mobile data tower 105 to the Internet 115. The total historical data from the firearm 15 can also be directly transmitted from the main microcontroller 55 to the Internet 115 through the Wi-Fi transmitter 70 and the mobile transmitter 75 of the firearm 15 as well. The Internet 115 is connected to a secure data center 120 which stores the total historical data from the firearm 15. In the event of a firing, or unlocking, the secure data center 120 can relay this information to law enforcement personnel 125, residences 130, and public buildings 135 such as schools, hospitals, airports, businesses, stores, malls, movie theaters, or the like, as well as dedicated subscribers 140 who are running a dedicated alerting app on a second cellular device 145. A multitude of dedicated or multifunctional radio frequency (RF) signals 150 transmits the required information from the secure data center 120 to the law enforcement personnel 125, the residences 130, the public buildings 135, and the subscribers 140 as necessary. Said information allows recipients to take corrective or protective action against the user 80 depending on the status or identification of the user 80. Finally, should a firearm 15 be stolen, the location information provided by the secure data center 120 would allow for quick recovery by the law enforcement personnel 125.

The preferred embodiment of the present invention can be utilized by the common user in a simple and effortless manner with little or no training. It is envisioned that the firearm activation and monitoring system 10 would be constructed in general accordance with FIGS. 1 through 3. The user 80 would procure the firearm 15 from conventional procurement channels such as firearm dealers or others with a Federal Firearms License (FFL). Due to the complexity and integration of the firearm activation and monitoring system 10, it is envisioned that it would be made available on newly manufactured firearms 15. Aftermarket installation on existing firearms 15 may be performed using specially aftermarket kits by authorized FFL installers.

After procurement and prior to utilization, the firearm activation and monitoring system 10 would be prepared in the following manner: during initial purchase of the firearm 15, it would be paired or programmed with the first mobile device 85 after verification and authentication in the FFL process. Subsequent selling would also be done by an FFL license holder. During said time, the operation of the firearm 15 with the first mobile telephone 85 as described in FIG. 3 would be verified and tested. At this point in time the firearm activation and monitoring system 10 is ready for utilization.

During utilization of the firearm activation and monitoring system 10, the following procedure would be initiated: When use of a firearm 15 is warranted by a user 80, including a private citizen, law enforcement officer, military personnel or the like, he or she would first perform an identification process via a fingerprint or PIN input on the first mobile telephone 85. Next, the grip area 20 is grabbed by the user 80 to activate the biometric sensors 25. If it is determined that the user 80 is in a calm and acceptable state, as described herein, the main microcontroller 55 will send the electrical signal to the trigger interlock 30, thus unlocking the trigger 35 and allowing the trigger 35 to be pulled and the firearm 15 to be fired. Upon firing of the firearm 15, identification information, location information, and other data is forwarded to all law enforcement personnel 125, residences 130, public buildings 135, and subscribers 140, thus allowing them to take corrective safety action for themselves or others. The law enforcement personnel 125 would automatically respond to the location to perform necessary actions as well. After use of the firearm activation and monitoring system 10, it is automatically reset by the main microcontroller 55, including repositioning of the trigger interlock 30 into the first position, and ready for additional operation as aforementioned described.

The present invention is described in terms of one or more specifically-described embodiments which is/are presented for purposes of illustration and not of limitation. Those skilled in the art will recognize that alternative embodiments not specifically described herein can be used in carrying out the present invention. Other aspects and advantages of the present invention may be obtained from a study of this disclosure and the drawings, along with the appended claims.

I claim:

1. A firearm activation and monitoring system comprising:
- a firearm having a trigger and grip area;
- a plurality of biometric sensors each located on said grip area;
- a trigger interlock located behind said trigger;
- a Bluetooth transmitter located in said firearm;
- a main microcontroller in electrical communication with said plurality of biometric sensors, said trigger interlock, and said Bluetooth transmitter;
- said trigger interlock is activated in a normal state to prevent said trigger operating a firing mechanism of said firearm;
- said plurality of biometric sensors can sense biometric data emanating from a user contacting said plurality of biometric sensors and transmit said biometric data to said main microcontroller;
- said main microcontroller can determine a mental state of said user based on said biometric data, generate a mental state report, and transmit said mental state report to a remote device through said Bluetooth transmitter;
- said remote device can receive said mental state report and verify authorization of said firearm based on said mental state report generated from said biometric data;
- said remote device can transit an authorization report to said main microcontroller through said Bluetooth transmitter; and
- said trigger interlock can deactivate when said main microcontroller receives said authorization report and allow said trigger to operate said firing mechanism of said firearm.

2. A firearm activation and monitoring system comprising:
- a firearm having a trigger and grip area;
- a plurality of biometric sensors each located on said grip area;
- a trigger interlock located behind said trigger;
- a main microcontroller in electrical communication with said plurality of biometric sensors and said trigger interlock;
- said trigger interlock is activated in a normal state to prevent said trigger operating a firing mechanism of said firearm;
- said plurality of biometric sensors can sense biometric data emanating from a user contacting said plurality of biometric sensors and transmit said biometric data to said main microcontroller;

said main microcontroller can measure said biometric data and verify a mental state of said user based on said biometric data; and said main microcontroller can deactivate said trigger interlock and allow said trigger to operate a firing mechanism of said firearm.

3. A firearm activation and monitoring system comprising:

a firearm having a trigger and grip area;

a plurality of biometric sensors each located on said grip area;

a trigger interlock located behind said trigger;

a Bluetooth transmitter located in said firearm;

a main microcontroller in electrical communication with said plurality of biometric sensors, said trigger interlock, and said Bluetooth transmitter;

said trigger interlock is activated in a normal state to prevent said trigger operating a firing mechanism of said firearm;

said plurality of biometric sensors can sense biometric data emanating from a user contacting said plurality of biometric sensors and transmit said biometric data to said main microcontroller;

said main microcontroller can transmit said biometric data to a remote device through said Bluetooth transmitter;

said remote device can receive said biometric data, generate a mental state report based on said biometric data, verify authorization of said firearm based on said mental state report generated from said biometric data; and transit an authorization report to said main microcontroller through said Bluetooth transmitter; and said trigger interlock can deactivate when said main microcontroller receives said authorization report and allow said trigger to operate said firing mechanism of said firearm.

* * * * *